US006817080B1

(12) United States Patent
Lanyon et al.

(10) Patent No.: US 6,817,080 B1
(45) Date of Patent: Nov. 16, 2004

(54) METHOD OF FABRICATING A MAILBOX

(75) Inventors: Charles Lanyon, Pottstown, PA (US); James K. Madara, Jr., Douglassville, PA (US); Richard J. Shreiner, Glenmore, PA (US)

(73) Assignee: Spring City Electrical Manufacturing Company, Spring City, PA (US)

( * ) Notice: Subject to any disclaimer, the term of this patent is extended or adjusted under 35 U.S.C. 154(b) by 0 days.

(21) Appl. No.: 10/455,011

(22) Filed: Jun. 4, 2003

(51) Int. Cl.[7] ..... B21D 39/00; B23P 19/04

(52) U.S. Cl. ..... 29/455.1; 29/463; 29/527.5; 232/38; 232/17

(58) Field of Search ..... 29/455.1, 460, 29/463, 527.1, 527.2, 527.5; 232/38, 17, 45

(56) References Cited

U.S. PATENT DOCUMENTS 3,825,173 A * 7/1974 Sunday ..... 232/17
4,247,039 A * 1/1981 Cornwell, Jr. ..... 232/35
4,275,829 A * 6/1981 Johnson et al. ..... 232/17
5,346,125 A * 9/1994 Critzer, Sr. ..... 232/17
5,575,422 A 11/1996 Peterman ..... 232/38
5,765,749 A * 6/1998 Harper ..... 232/17
6,474,543 B2 * 11/2002 Grell ..... 232/38
6,729,535 B2 * 5/2004 Lackey et al. ..... 232/17

* cited by examiner

*Primary Examiner*—Essama Omgba
(74) *Attorney, Agent, or Firm*—Drinker Biddle & Reath LLP

(57) ABSTRACT

A method of fabricating a mailbox is disclosed comprising the steps of obtaining an extruded metal bar having a generally L-shaped cross section defining an elevation flange and a base flange, wherein the length of the elevation flange is selected to correspond to the desired height of the side walls of the mailbox and the length of the base flange is selected to correspond to one-half of the desired width of the mailbox floor. The outside face of the elevation flange has one or more areas shaped as a decorative molding detail to create the appearance of a case mailbox. The base flange has an inside face in a pattern of raised longitudinal ribs that define a grooved surface. The open channel of the mailbox is created by cutting two equal-length billets from the extruded bar, welding them together facing each other, attaching a back pate, a hinged door plate and an ornamental cast metal roof. The appearance of the finished box creates the illusion of a cast metal mailbox.

9 Claims, 3 Drawing Sheets

METHOD OF FABRICATING A MAILBOX

FIELD OF THE INVENTION

The invention relates to the general field of fabricating metal containers, and to the specific field of fabricating a metal mailbox.

BACKGROUND OF THE INVENTION

In addition to the utilitarian function of protecting mail pick-up and delivery from the elements, mailboxes often are used as outdoor decoration. Fine quality mailboxes can be used to match or complement the architectural style of the residence or grounds with which they are associated.

Some of the most attractive, and commensurately expensive, mailboxes are metal structures fabricated by casting the entire box, sans trap door and other accessories, in foundry molds. A similar alternative is to cast the walls and floor in one mold, and the roof in another, then join the roof over the cavity. In either method, the beauty of the box derives in part from the intricate surface detail that can be produced in a mold, blended with the appearance of structural mass and permanence.

The drawback to cast metal mailboxes boxes is clearly the cost of fabrication. Mailboxes can be made much more cheaply by assembling stamped parts, or parts cut from a metal sheet or roll, but it is difficult to give these inexpensive boxes the appearance of a cast mailbox. Usually the surface detail is added in plastic molding strips or polished metal plates attached to the sidewalls by screws or adhesive.

Consequently, this invention is directed to a method of fabricating mailboxes with an appearance that closely resembles, and creates the illusion of, a decorative cast metal mailbox, while forming at least the sidewalls and floor in a less expensive manner.

SUMMARY OF THE INVENTION

The invention uses extruded metal angle bars as the stock for fabricating the floor and side walls. The bars can be extruded at relatively low cost in lengths of twenty to thirty feet or more, and then cut into pairs of equal length billets to be joined together. An extruded of this type has a generally L-shaped cross section, comprising an elevation flange and a base flange. The dimensions are chosen such that the length of the elevation flange corresponds to the height of the sidewalls, and the length of the base flange corresponds to one-half of the width of the floor.

The extruded bars can be custom made for the mailbox fabrication. The extruder dye is designed to produce a flat inside face on the elevation flange, while the outside face of the elevation flange has one or more areas shaped as a decorative molding detail. The extruder dye also produces a generally flat outside face on the base flange, while the inside face of the elevation flange has a pattern of longitudinal raised ribs.

Two equal-length billets can be cut from an extruded bar, or from identical extruded bars, at a length selected for the desired depth of the mailbox cavity. The billets are then positioned to face each other, with the ends aligned, and welded together at spots along the seam. This produces a mailbox cavity that, when finished, appears to be a cast unit.

The cavity is then closed at one end by tack welding a back plate to the rear edges of the side walls created by the billets. The back plate can be east in a metal mold or cut to length from an extruded bar. In a preferred embodiment, the back plate continues the decorative molding detail of the sidewalls. This continued detail makes the entire mailbox cavity appear to be a cast unit.

To complete the appearance, an ornamental cast metal bonnet, complimentary to the molding detail, is placed over the cavity and attached to the side walls and back plate.

A hinged door is added to the front, and other accessories may be applied to the box. Some specifics of these features will be apparent from the detailed description which follows.

BRIEF DESCRIPTION OF THE DRAWINGS

For the purpose of illustrating the invention, the Figures show a preferred embodiment. The invention is not limited, however, to the precise arrangements shown as a preferred embodiment. A variety of modifications to the embodiment may be described or apparent to those skilled in the art. Thus, refer to the appended claims, rather than to the drawings and specification, for the scope of the invention.

DETAILED DESCRIPTION OF THE DRAWINGS

The Figures show a preferred embodiment. A variety of modifications to the embodiments described will be apparent to those skilled in the art from the disclosure provided herein. Thus, the present invention may be embodied in other specific forms without departing from the spirit or essential attributes thereof and, accordingly, reference should be made to the appended claims, rather than to the foregoing specification, as indicating the scope of the invention.

Figure 1:
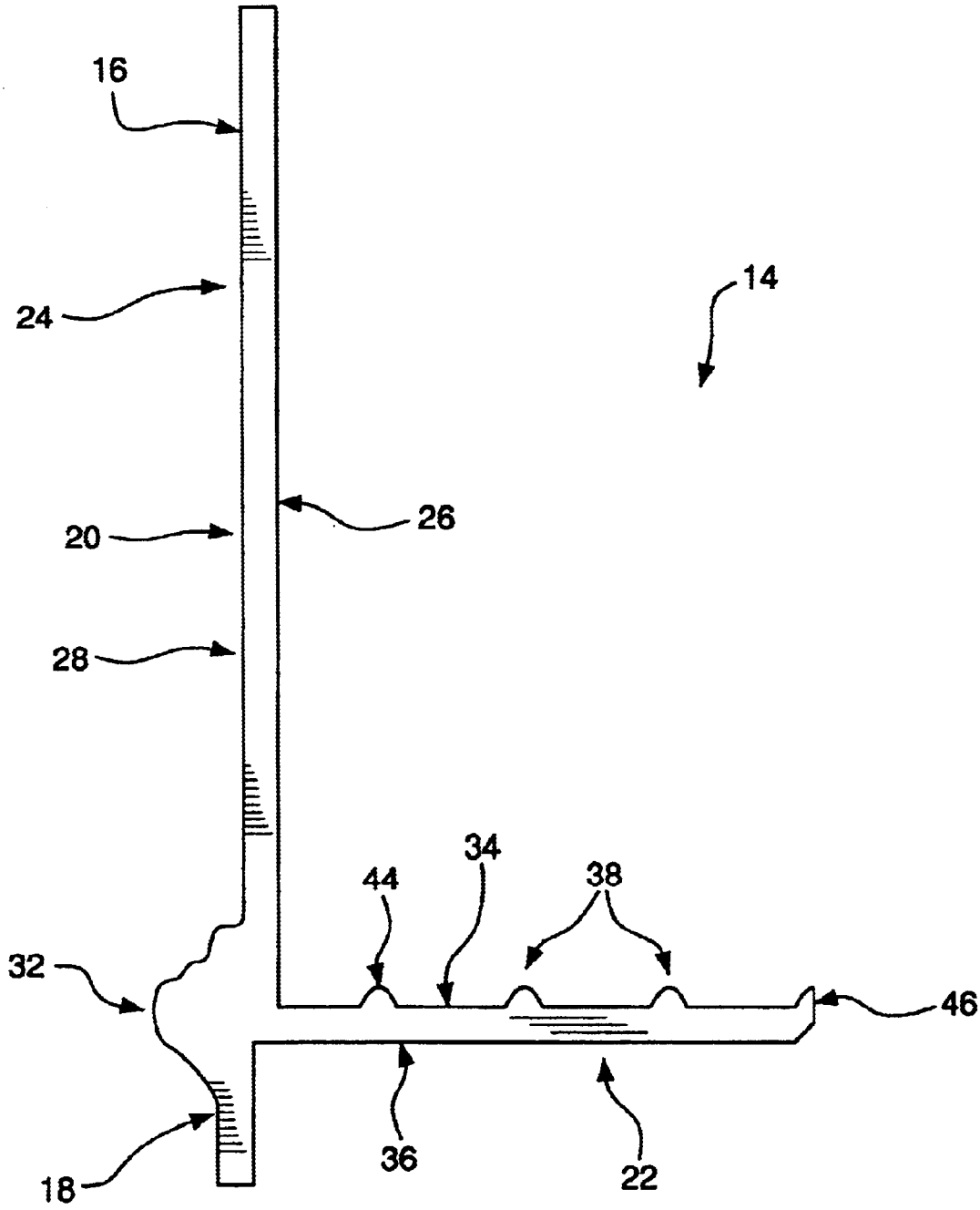
FIG. 1 is a cross-sectional view of an extruded angle bar used to form a mailbox body according to the method of the present invention.
Figure 2:
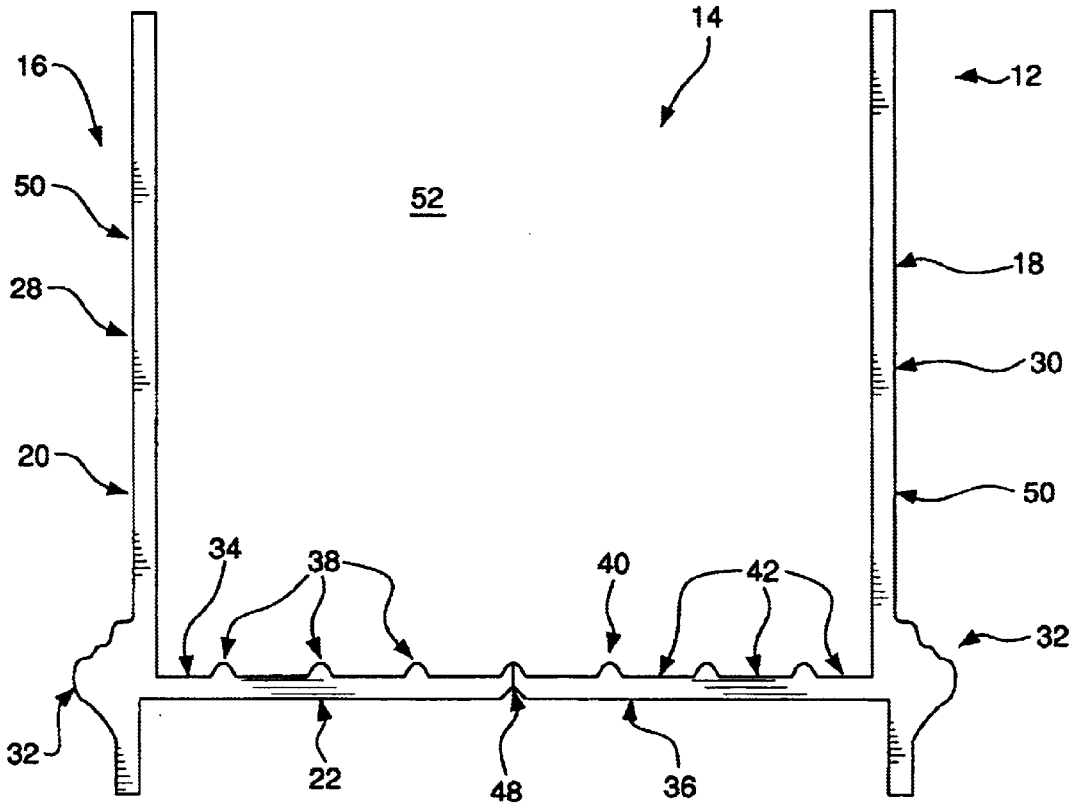
FIG. 2 is a cross-sectional view of facing billets cut from an extruded angle bar used to form a mailbox body according to the method of the present invention.

A mailbox 10 according to the present invention comprises a mailbox body 12 forming a mailbox cavity 14 for receiving mailed items. An extruded metal angle bar 16 which is used to form the mailbox body 12 has a generally L-shaped cross section, as shown in FIGS. 1 and 2, comprising an elevation flange 20 and a base flange 22. The base flange 22 extends in a generally perpendicular direction from a lower portion of the elevation flange 20, such that a short lower portion 18 of the elevation flange 20 extends vertically downward from the intersection of base 22 and elevation flanges 20, and a longer upper portion 24 of the elevation flange 20 extends vertically upward from the intersection of base 22 and elevation flanges 20. The dimensions are chosen such that the length of the upper elevation flange 20 corresponds essentially to the desired height of the mailbox cavity 14, and the length of the base flange 22 corresponds essentially to one-half of the desired width of the mailbox cavity 14.

The inside face 26 of the elevation flange 20 (i.e., face closer to the base flange 22) is preferably flat. The outside face 28 of the elevation flange 20 preferably has a substantial flat area 30 and one or more areas shaped as a decorative molding detail 32. In FIG. 2, the substantial flat area 30 is most of the outer side wall 18 of the mailbox 10, while a decorative molding detail 32 is located generally opposite the base flange 22. It should be apparent that the decorative molding detail 32 can be varied in appearance, that it can be located at a different height on the elevation flange 20, and that one or more decorative molding details can be made by so shaping the extrusion dye for the bar 16.

The outside face 36 of the base flange 22 is preferably flat. The inside face 34 of the base flange 22 preferably has a pattern of longitudinal raised ribs 38 that define a grooved mail-supporting surface 40. The pattern of raised longitudinal ribs is preferably spaced across the base flange such that the base flange terminates at an end that is formed as one half of a raised rib. The base flange's outside face preferably tapers toward its inside face at the outboard end of the base flange to form a seam when two billets are joined as described below. Any free water present in the mailbox cavity 14, such as condensation or rainwater, should collect in the grooves 42 formed between adjacent ribs 38, or between one of the ribs 38 and the inside face 26 of the elevation flange 20, while paper envelopes can be supported by the crests 44 of the ribs 38 in a plane above the water.

To fabricate the mailbox 10, two equal-length billets are cut from the extruded angle bar 16, or cut from two similar angle bars. The length of the billets is selected to correspond to the desired depth of the mailbox cavity 14. The billets are then positioned to face each other, as shown in FIG. 2, with the ends aligned and the outboard edges 46 of the base flange 22 pressed adjacent to each other to create a scam 48. The billets are then joined together along the seam 48 by any conventional means, preferably by tack welding the seam 48 at several sites. When so joined, the billets form a mailbox body 12, with an open rectangular channel 52 that corresponds to the mailbox cavity 14, and side walls 50 that correspond to the elevation flange 20 of the angle bars 16.

Figure 3:
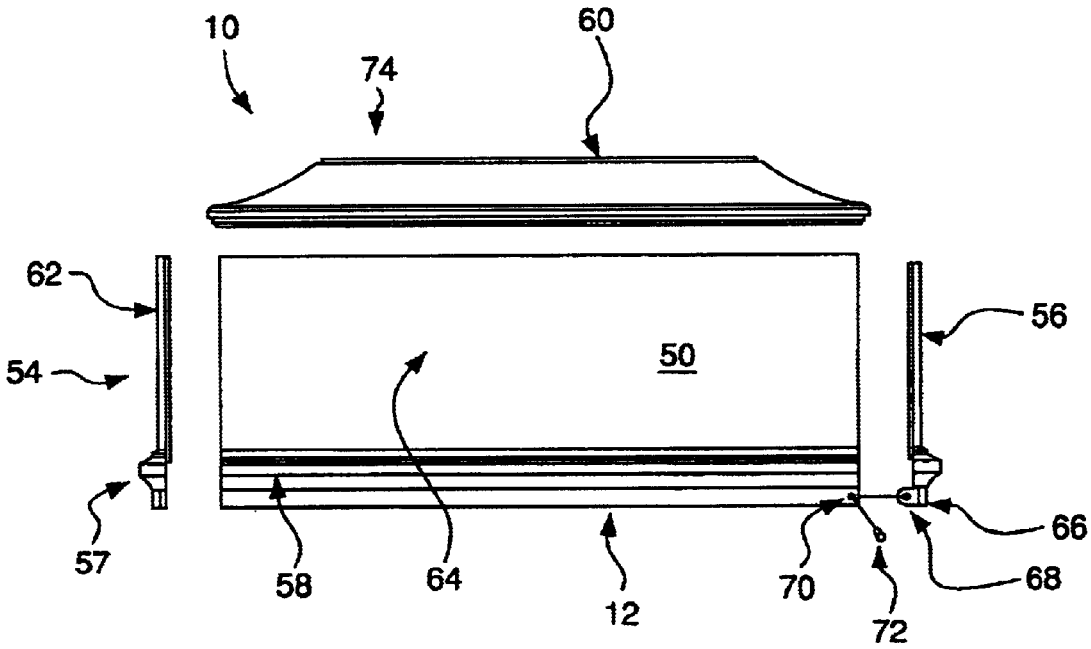
FIG. 3 is a side elevation view of a mailbox according to the method of the present invention, showing the roof, back plate, and hinged door prior to attachment to the mailbox body.

As shown in FIG. 3, the open channel 52 is then closed at one end by adding a back plate 54 forming a back wall of the mailbox. The back plate 54 is preferably a metal plate that continues the decorative molding detail 58 of the mailbox body 12 on its outside surface 62. The back plate 54 can be cast in a metal mold or cut to length from an extruded bar. In either method of manufacture, the back plate 54 is generally flat on one side (which will be facing the inside of the mailbox cavity), and has a substantial flat area and one or more areas shaped as a decorative molding detail 57 to conform as a corner continuation of the molding detail 58 on the outside face 64 of the side walls 50. The back plate 54 is attached to the billets forming the mailbox body 12, preferably by tack welds.

A hinged door plate 56 is attached to the mailbox body 12 at the end opposite the back plate 54. The door plate 56 may continue the decorative molding detail on its outside surface, similar to the back plate 54. If the back plate 54 is cast in a metal mold, a door plate 56 can be made by similar mold or mold inserts to be slightly shorter than the back plate 54, so that it is clear of the roof 60 of the mail box 10. If the back plate 54 is cut to length from an extruded bar, the door plate 56 can be similarly cut from the bar and the top trimmed to reduce the height to below the roof 60. On the other hand, since the door plate 56 would not be a unitary part of an entirely cast mailbox, it would not diminish the illusion of a cast mailbox to have the door plate 56 not continue any of the molding detail from the side walls and back plate. The door plate 56 also has short hinge tabs 66 attached on each bottom edge, facing inward. The hinge tabs 66 can be part of the door plate 56 or attached to the door plate 56 to appear to be a part of the door plate 56. Each hinge tab 66 has a small aperture 68, to be aligned with a corresponding aperture 70 in the lower front of the side walls, and have a hinge pin 72 passed through all the aligned apertures 68, 70 on both sides.

The mailbox roof 60 is an ornamental cast metal bonnet 74, which may have ornamental shape and/or molding detail that is complimentary to the molding detail on the side walls. The roof 60 is placed over the side walls 50 and back plate 54 and attached to them, preferably by tack wells at the corners.

The mailbox 10 is then ready for finishing. The welds are polished to blend into the adjacent metal surfaces, and all surfaces are cleaned, primed and painted. The painted mailbox 10 then has the appearance and illusion of being an entirely cast box.

A decorative handle, such as a polished metal knob, may be attached to the door plate 56. A door catch, such as a clasp and spear mechanism, may be added in the upper center or at each upper corner of the door. A pivoting flag and flag-holder may be added to indicate the presence of mail. A bright metal address plate my be added to the side walls. Other decorative or useful features, such as mounting rings and/or a cantilever bracket may be added with diminishing the appearance and illusion of a cast mailbox.

The present invention may be embodied in other specific forms without departing from the spirit or essential attributes thereof and, accordingly, reference should be made to the appended claims, rather than to the foregoing specification, as indicating the scope of the invention.

We claim:

1. A method of fabricating a mailbox having side walls, a back wall, a floor, a roof and a door, comprising the steps of:

(a) obtaining an extruded metal bar having a generally L-shaped cross section defining an elevation flange and a base flange, wherein (i) the length of the elevation flange is selected to correspond generally to a desired height of the side walls of the mailbox, and the length of the base flange is selected to correspond generally to one-half of a desired width of the floor, (ii) the elevation flange has an outside face and an inside face, with the outside face having a substantial flat area and an area shaped as a decorative molding detail, and (iii) the base flange having inside and outside faces and having an outboard edge opposite the elevation flange;

(b) cutting two equal-length billets from the extruded bar, the length of the billets corresponding to a desired length of the mailbox, (c) positioning the billets to face each other and aligned such that outboard edges of the base flanges are pressed against each other to create a seam;

(d) joining the billets along the seam to create a open rectangular channel comprising the side walls and floor;

(e) joining a back plate to the billets to close one end of the open channel and form the back wall;

(f) attaching a hinged door to the billets at the end of the channel opposite the back wall; and, (g) attaching an ornamental cast metal roof over the side walls and back plate.

2. A method of fabricating a mailbox as in claim 1, wherein the inside face of the base flange includes a pattern of raised longitudinal ribs.

3. A method of fabricating a mailbox as in claim 2, wherein the pattern of raised longitudinal ribs is spaced across the base flange such that the base flange terminates at an end that is formed as one half of a raised rib.

4. A method of fabricating a mailbox as in claim 3, further comprising the base flanges' outside face tapering toward its inside face at the outboard end of the base flange.

5. A mailbox fabricating by the steps of claim 4.

6. A mailbox fabricating by the steps of claim 2.

7. A method of fabricating a mailbox as in claim 1, wherein the back plate forming the back wall has an outside face that contains a decorative molding detail that conforms as a corner continuation of the molding detail on the elevation flanges.

8. A mailbox fabricated by the steps of claim 7.

9. A mailbox fabricated by the steps of claim 1.

* * * * *